United States Patent [19]

Hogg

[11] 3,988,128

[45] Oct. 26, 1976

[54] ELECTRIC PARTICLE PRECIPITATOR

[75] Inventor: Walter R. Hogg, Miami Lakes, Fla.

[73] Assignee: Coulter Electronics, Inc., Hialeah, Fla.

[22] Filed: May 21, 1974

[21] Appl. No.: 468,981

[52] U.S. Cl. ..... 55/10; 55/107; 55/120; 55/123; 55/127; 55/139; 55/228; 55/270

[51] Int. Cl.[2] ..... B03C 3/16

[58] Field of Search ..... 55/2, 10, 12, 13, 101, 55/107, 108, 117, 118, 120, 122, 123, 127, 134, 139, 228, 270

[56] References Cited

UNITED STATES PATENTS

| | | | |
|---|---|---|---|
| 1,958,406 | 5/1934 | Darrah | 55/123 UX |
| 2,357,354 | 9/1944 | Penney | 55/107 |
| 2,924,294 | 2/1960 | Johnstone | 55/107 X |
| 3,409,409 | 11/1968 | Sackett, Sr. | 55/227 X |
| 3,494,099 | 2/1970 | Eng et al. | 55/DIG. 34 |
| 3,551,710 | 12/1970 | Gourdine | 310/10 |
| 3,681,896 | 8/1972 | Velkoff | 165/17 X |

FOREIGN PATENTS OR APPLICATIONS

| | | | |
|---|---|---|---|
| 770,619 | 7/1934 | France | 55/107 |
| 300,589 | 9/1917 | Germany | 55/107 |
| 607,854 | 9/1960 | Italy | 55/10 |
| 1,184,389 | 3/1970 | United Kingdom | 55/237 |

OTHER PUBLICATIONS

German Printed Application No. 2024423, inventor Otto Schmid, 55–107, printed 12–9–71).

*Primary Examiner*—Frank W. Lutter
*Assistant Examiner*—David L. Lacey
*Attorney, Agent, or Firm*—Silverman & Cass, Ltd.

[57] ABSTRACT

A method and apparatus are disclosed wherein an a.c. signal charges droplets sprayed into a chamber as the droplets are formed. The frequency of the a.c. signal is high enough so that the individual droplets are charged differently than their neighbors. The differently charged droplets create a nonuniform electric field within the chamber. The nonuniform electric field causes particles, entering the chamber in a fluid medium such as air, to be attracted to and attach to the droplets thereby precipitating out of the fluid medium.

16 Claims, 4 Drawing Figures

ELECTRIC PARTICLE PRECIPITATOR

BACKGROUND OF THE INVENTION

In the particle precipitator art, precipitators are well known in which a fluid medium such as air, from which dust or other particulate matter is to be separated, is brought into intimate contact with a liquid, usually water, while, to enhance the interaction between the air and water, the active surface of the water is increased by injecting it into the air flow as jets or curtains in which the water is distributed in the form of small droplets. The precipitation efficiency of this type of apparatus is dependent upon the volume of water injected into the air flow.

Precipitators are also well known in which the particulate matter, after having been charged to high voltage by means of a corona discharge, is removed from a fluid medium by deflection of the charged particulate matter to a high voltage plate. These types of precipitators suffer from the disadvantage that very high voltages must be employed in order to create the corona discharge and the deflection of the particulate matter. The high voltage levels require that the precipitator be very well insulated in order to prevent injury to persons coming into contact with the device.

Precipitators are also well known which combine the heretofore mentioned types. In the combined precipitator the fluid medium such as air, containing the particulate matter to be separated is brought into contact with jets of liquid droplets. The droplets are charged to a high d.c. potential when formed. This precipitator is at least as efficient as either aforementioned type while combining the best features of both. While this precipitator requires less liquid than the first and less power than the second, it still requires the high d.c. voltage necessary to develop the corona discharge. Again, a great deal of insulation would be required in order to prevent insulation breakdown and to protect persons coming in contact with the device.

SUMMARY OF THE INVENTION

In practicing this invention, an apparatus is provided for removing particulate matter suspended in a fluid medium. The apparatus includes a precipitator having a precipitation chamber therein through which the fluid medium passes. A fluid, such as water, is coupled to the chamber and is formed into droplets when coupled into the chamber. An a.c. generator couples an a.c. signal to the fluid such that each droplet, when formed, will develop a substantially fixed charge thereon. The frequency of the a.c. signal is high enough so that each individual droplet has a charge which is different in magnitude and/or polarity from any of its immediate neighbors. The differently charged droplets within the chamber create a nonuniform electric field within the chamber. This nonuniform electric field causes the particulate matter in the fluid medium to be attracted to and attach to the droplets thereby causing the particulate matter to precipitate out of the fluid medium.

The method of precipitating particulate matter from a fluid medium also is envisioned as being encompassed in this invention. This method can include the following steps.

A. spraying droplets of fluid into a precipitation chamber,

B. applying an a.c. signal to the droplets, for randomly charging the droplets as they are sprayed into the chamber whereby the droplets create a nonuniform electrical field within the chamber, C. exposing the fluid medium with particulate matter suspended therein to the nonuniform electric field and the randomly charged droplets in the precipitation chamber for precipitating the particulate matter from the fluid medium, and D. accumulating the droplets and particulate matter.

DESCRIPTION OF THE PREFERRED EMBODIMENTS

Figure 1:
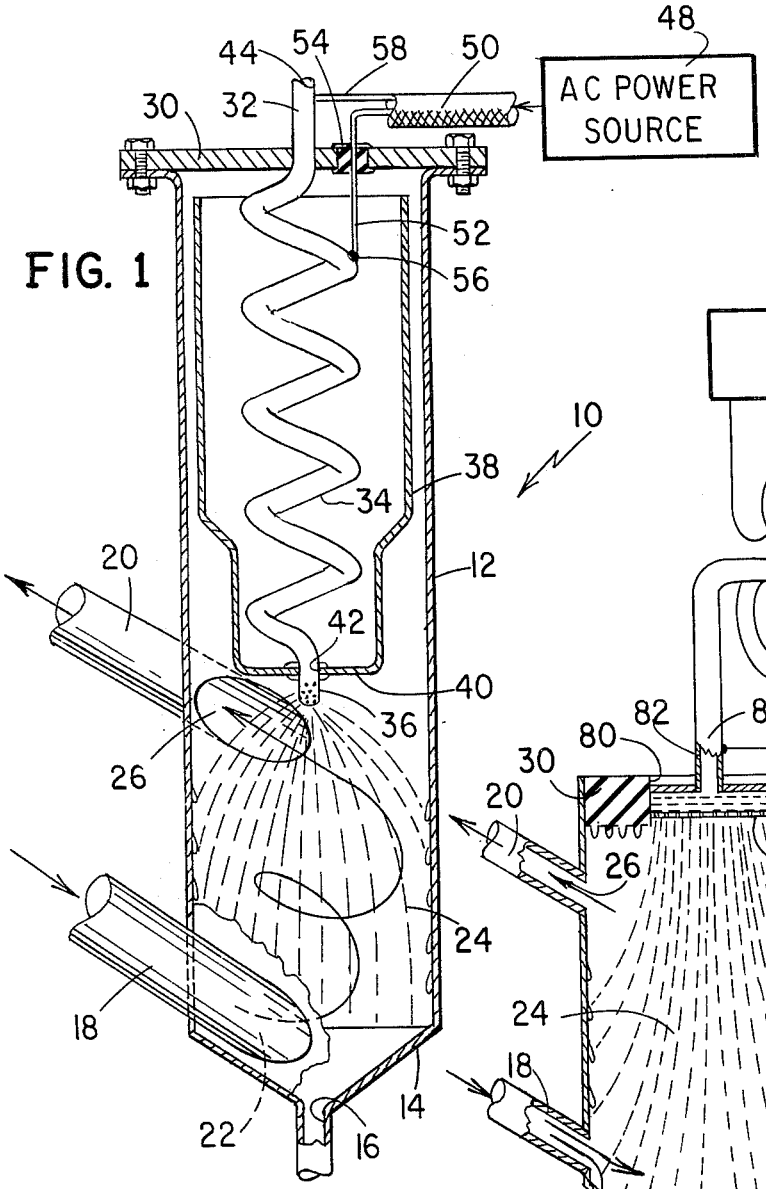
FIG. 1 is a partial cutaway view of a preferred embodiment of the particle precipitator of this invention.

Referring to FIG. 1, electric particle precipitator 10 includes a generally cylindrically-shaped elongate housing 12 having a closed funnel-shaped housing bottom 14. A waste exit port 16 is formed in the center of bottom 14. Entry and exit tubes 18 and 20 are secured to the side of housing 12 in a tangential manner. Elliptical opening 22 in the sidewall of housing 12 allows dust laden air, or any other particulate matter laden fluid medium to enter precipitation chamber 24 in housing 12. For the remainder of this description the fluid medium will be considered to be air containing dust particles. The opening 26 in the sidewall of housing 12 allows air to exit precipitation chamber 24 via exit tube 20. Top member 30 is secured to housing 12 and has a conduit tube 32 passing through it into precipitation chamber 24. A coil shaped portion 34 of conduit tube 32 is formed internal to precipitation chamber 24. A nozzle 36 is formed at the end of coil portion 34. A cylindrically-shaped can 38 having a top wall 40 is inserted over the coil portion 34 of conduit tube 32 with nozzle 36 extending through an aperture 42 in top wall 40. End 44 of conduit tube 32, external to housing 12, is coupled to a source of fluid. The fluid may for example be water and for the remainder of this description will be considered to be water.

An a.c. power source 48, which in the preferred embodiment is a radio frequency (RF) source, is coupled to electric particle precipitator 10 via coaxial cable 50. The center conductor 52 of coaxial cable 50 is coupled through an insulator 54 in top member 30 of housing 12 to tap 56 on coil portion 34 of conduit tube 32. The shield 58 of coaxial cable 50 is connected to the portion of conduit tube 32 external to housing 12, which, in the preferred embodiment, is coupled to ground potential at top member 30 of housing 12.

In operation, the air having particulate matter suspended therein is coupled into entry tube 18. The air is laden with particles such as dust and dirt. Because of the tangential attachment of entry tube 18 and the elliptical configuration of opening 22, the air entering precipitation chamber 24 will circulate around the periphery of chamber 24 spiral upwards towards exit opening 26 as shown by the arrow in FIG. 1, and exit via opening 26 and tube 20. This circulating motion will create a "cyclone effect" in chamber 24.

At RF frequencies, can 38, secured to coil section 34 acts to form a capacitor in parallel with coil portion 34 of conduit tube 32 in addition to protecting coil portion 34 from any spray produced by nozzle 36. Coil portion 34 itself acts as an inductor so that the combination of coil section 34 and can 38 forms a resonant circuit consisting of an inductor and capacitor. This resonant circuit is resonant at the frequency of the signal generated by the RF source 48 so that the RF signal coupled from a.c. power source 48 is raised to a high RF voltage level across the resonant circuit. Because the resonant circuit is mounted internal to housing 12 which is grounded, the energy is contained or isolated preventing injury to persons coming in contact with the precipitator and minimizing unwanted RF radiation.

The water, which has enough impurities to be electrically conductive, is coupled to conduit tube 32 at end 44. This water passes through the entire length of conduit tube 32 including coil portion 34 and is ejected as droplets via nozzle 36. As the water is passed through coil portion 34 of conduit tube 32, it is subjected to the RF signal developed across the resonant circuit. As each droplet of water exiting nozzle 36 is formed, a charge is trapped on it corresponding to the voltage on the nozzle at the instant of formation. This charge can, of course, be either positive or negative, and can be any value within the range of voltages developed across the resonator. The nozzle can be thought of as many droplet forming jets operating simultaneously. The water breaks off into droplets from each of these jets or incremental areas at a droplet forming frequency dependent upon water pressure, jet size, viscosity, surface tension, etc. If separate droplet forming jets are employed each droplet forming jet will have a frequency rate of droplet formation which is the same as or less than the RF frequency developed by a.c. power source 48. It is not necessary for the frequency of a.c. power source 48 to be greater than the droplet formation of all the jets combined. Because the frequency or rate of droplet formation is so much less than the RF frequency developed by a.c. power source 48, substantially every droplet formed at nozzle 36 will have a charge which is different in magnitude and/or polarity from any of its neighbor droplets. The charged droplets formed at nozzle 36 will disperse through precipitation chamber 24 wetting a conically shaped volume within chamber 34. The droplet, because of their different polarities and charge magnitudes, will cause a nonuniform electric field to be developed between the droplets in chamber 24.

The particles in the particulate laden air entering via entry tube 18 and opening 22 can have a positive charge, a negative charge or zero net charge. It can easily be seen that the particles having a positive or negative charge will be deflected by the nonuniform electric field and will further be attracted to and will attach to particular charged droplets. However, the nonuniform electric field will also cause those particles having zero net charge to be deflected towards and attach to particular charged droplets. The droplets with particles attached to or suspended in them will eventually strike the sidewalls of housing 12 and drip down to funnel-shaped bottom 14 and into waste exit port 16 where the waste liquid and collected particulate matter can be expelled or withdrawn.

Figure 2:
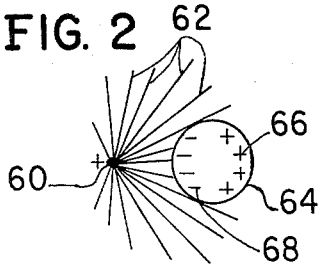
FIG. 2 shows a dipole in a nonuniform electric field.

Attention is invited to FIG. 2 which may be considered helpful in illustrating what is believed to be the theoretical basis for deflection of particles which have a zero net charge. In FIG. 2, a positive charge 60 is shown. Positive charge 60 causes a nonuniform electric field to be developed. This nonuniform electric field is represented by electrical lines of force 62 which extend radially from positive charge 60. Any zero net charge particle 64 entering the influence of this field will redistribute its positive and negative charges 66 and 68 respectively as shown. Even though particle 64 has an equal number of positive and negative charges 66 and 68 respectively, it will be drawn towards positive charge 60 since the greater proximity of the negative charges overcomes the repelling force of the positive charge. If particle 64 was placed in a uniform field, that is, a field where the lines of force, such as lines 62, were all parallel to one another rather than extending radially from a particular point such as exists for example between the plates or in a parallel plate capacitor, the positive and negative charges 66 and 68 respectively in particle 64 would redistribute as shown in FIG. 2 but particle 64 would not be affected by the field. In a uniform field such as exists in the above noted parallel plate capacitor, the attraction of the positive charges 66 towards the negative electrode would be equal to the attraction of the negative charges 68 towards the positive electrode. Because of this equal attraction of the positive and negative charges to the electrode of opposite sign, particle 64 would experience zero net force.

Figure 3:
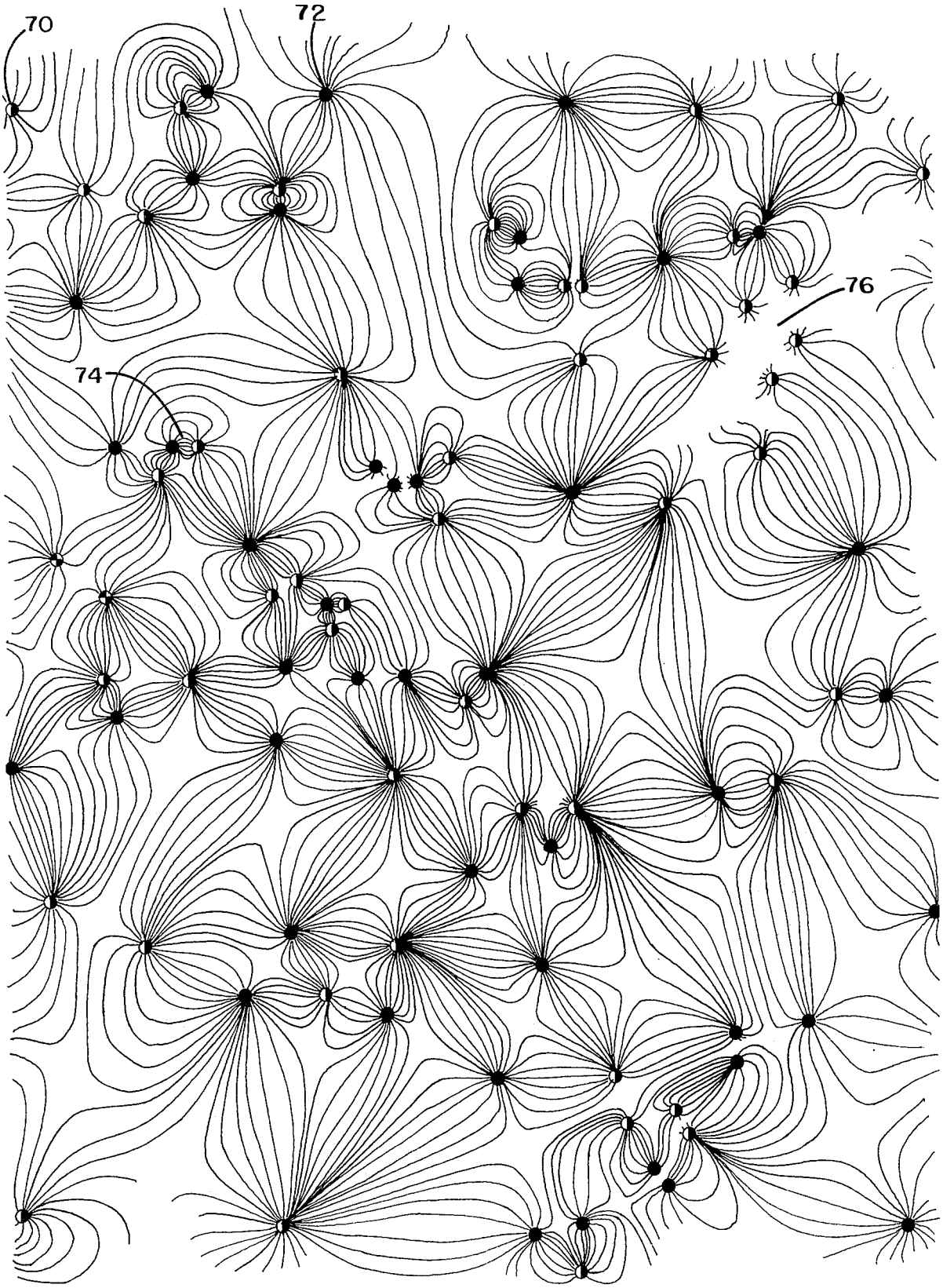
FIG. 3 is a two dimensional representation of an electric field developed in the particle precipitator of FIG. 1.

Referring now to FIG. 3, there is shown a representation of the type of nonuniform electric field pattern which can exist within housing 12 at any particular point of time. It should be understood, however, that this is merely presented as a theory of what the field pattern can look like and that this is an attempt to illustrate via a two dimensional drawing what is in actuality a three dimensional field.

The field pattern shown in FIG. 3 was drawn by use of a magnetic analogy. Half filled circles 70 represent droplets charged with one polarity which, for purposes of this illustration will be considered positively charged droplets. Fully filled circles 72 represent droplets charged to the opposite polarity, which, for purposes of this illustration will be considered negatively charged droplets. In quite a few cases, droplets of opposite charge are very close together such as for example location 74. At locations such as location 74, the droplets, even if they have not been oppositely charged to the maximum voltage available, will create an extremely high voltage gradient between them. It is possible, indeed probable, that because of the high gradient and the moisture content of precipitation chamber 24, a minute arc could be created if the voltage gradient between the oppositely charged droplets exceeds the breakdown voltage of the air. The arc produced would have the same effect as a corona. It would produce ions which could attach to nearby particles thus changing the net charge of the particle so as to cause it to be attracted towards and attach to one of the droplets.

Attention is directed towards the area identified as location 76 in FIG. 3. At location 76 several droplets are located all having a net positive charge. Because no lines of force are shown between these positively charged droplets, it would appear that here is no electric field at location 76. However, it should be recalled that FIG. 3 is an attempt at a two dimensional representation of a three dimensional field. If a three dimensional representation could be shown, negatively charged droplets would be present in front of and behind the positively charged droplets shown at location 76 in FIG. 3. The lines of force at this location would then extend in a direction substantially perpendicular to the plane of the paper upon which FIG. 3 is drawn. Furthermore, it should be noted that FIG. 3, because of the movement of the droplets and the movement of the particulate laden gas, represents an attempt to illustrate the non-uniform field created at a particular instance in time, in an environment where the nonuniform electric field created in continuously varying. In view of the complex, continuously varying, nonuniform electric field developed within precipitation chamber 24 as illustrated in FIG. 3, it should be apparent that the probability of any particle, passing through precipitation chamber 24 without being attracted to and attaching to a droplet of water is very low. This includes particles having a zero not charge.

Figure 4:
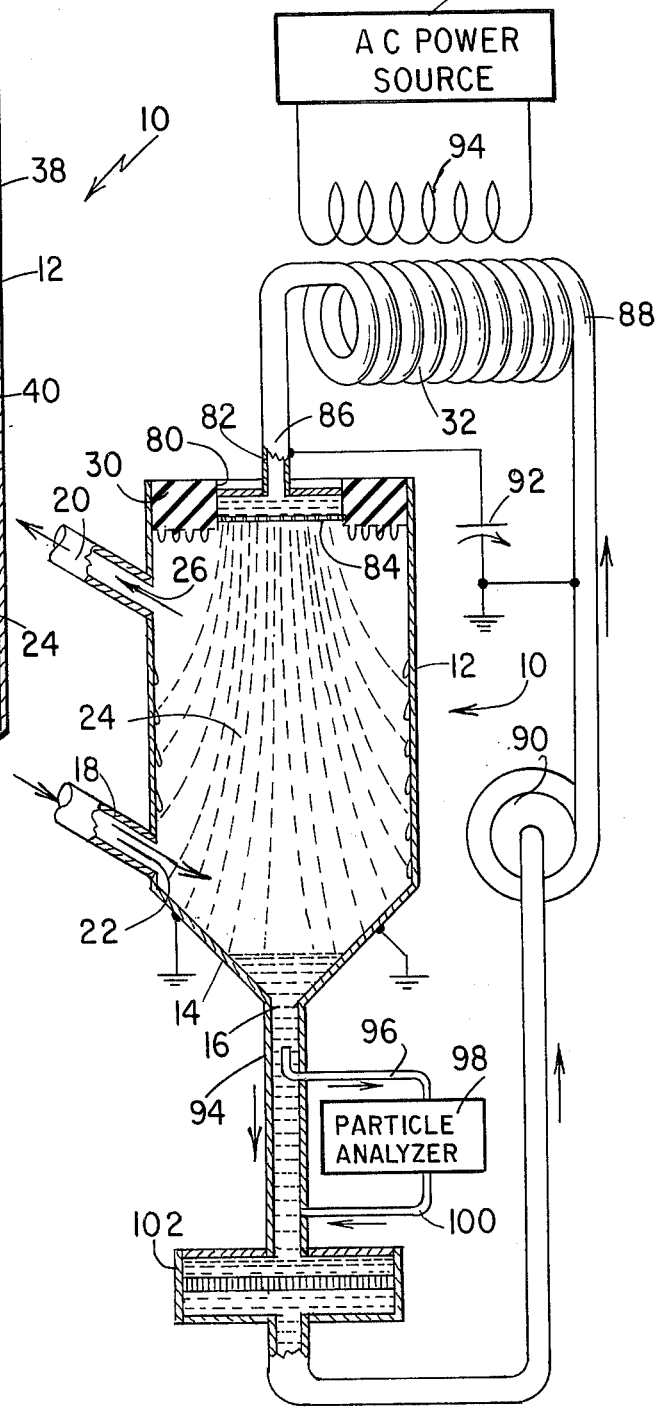
FIG. 4 is a block diagram of a particle analysis system including a partial cutaway view of another embodiment of the electric particle precipitator of this invention.

Referring to FIG. 4 there is shown in another embodiment of the electric precipitator 10 of this invention employed in a particle analyzing system. Parts of electric particle precipitator 10 which are identical to those shown in FIG. 1 will have identical reference numbers. Electric particle precipitator 10 again includes a generally cylindrically shaped housing 12 having a funnel-shaped housing bottom 14. A waste exit port 16 is formed in the center of bottom 14. Entry and exit tubes 18 and 20 are secured to the side of housing 12 in a tangential manner as shown in FIG. 1. Opening 22 in sidewall of housing 12 allows dust laden air to enter precipitation chamber 24. Opening 26 in the sidewall of housing 12 allows air to exit precipitation chamber 24 via exit tube 20. Top member 30 is, in this embodiment, an insulating material. An aperture 80 is formed in the center of top member 30 and a nozzle 82 containing a plurality of spray orifices 84 is secured to the sidewalls of aperture 80. Conduit tube 32 is formed external to precipitation chamber 24 and is connected at end 86 to nozzle 82 and at end 88 to a pump 90. A capacitor 92 is connected in parallel with conduit tube 32 between ends 86 and 88. Just as in FIG. 1, conduit tube 32 is coiled and forms an inductor in parallel with capacitor 92. The parallel inductance and capitance forms a resonant circuit for impressing an a.c. signal on the water passing through conduit tube 32.

A coil 94 is positioned so as to be mutually coupled to conduit tube 32. Coil 94 is connected directly to a.c. power source 48. In this embodiment, the a.c. signal developed by power source 48 is coupled to conduit tube 32 via the mutual inductance created between conduit tube 32 and coil 94.

An explanation of the operation of particle precipitator 10 in FIG. 4 will not be provided as it is identical to the operation described with reference to the precipitator of FIG. 1 except that in FIG. 4 the resonant circuit is located external to the precipitator housing 12 so that the entire apparatus would have to be enclosed in an additional housing in order to confine the radio frequency field and minimize the dangers to persons coming into contact with the apparatus. Additionally in FIG. 4 a number of spray openings 84 are provided for spraying the water into precipitation chamber 24 and the a.c. signal is mutually coupled to conduit tube 32.

In FIG. 4, waste exit port 16 is connected to a drain tube 94. A sample tube 96 is inserted into drain tube 94 for drawing off a small amount of water and trapped particulate matter. Sample tube 96 is connected to a particle analyzer 98 which may, for example, be a Coulter type particle analyzing device such as is described in U.S. Pat No. 2,656,508. The particulate matter in the water is analyzed by particle analyzer 98 in order to determine certain characteristics of the particles such as size. After analysis, the fluid and particulate matter is returned to drain tube 94 via return tube 100. For a more detailed illustration of a particle analyzing system such as is described hereinabove, reference is made to U.S. Pat. No. 3,689,833.

The particle laden water passing through drain tube 94, including that returned via return tube 100 passes to a filter 102 connected to the bottom of drain tube 94. Filter 102 filters all of the particulate matter from the water. Pump 90 connected between the output of filter 102 and the input end 88 of conduit tube 32 is used to return the filtered water to conduit tube 32 so that it may be used again in the operation of electric particle precipitator 10.

It is to be understood that the method for removing particulate matter suspended in a fluid medium such as air as hereinbefore described with reference to the apparatus used for performing this function, is also considered novel. This method includes the steps of spraying droplets of a fluid such as water into a precipitation chamber; applying an a.c. signal to the droplets as they are sprayed into the chamber for randomly charging the droplets in order to create a nonuniform electric field within the chamber; exposing the fluid medium such as air with particulate matter suspended in the medium to the nonuniform electric field and the droplets in the precipitation chamber for precipitating the particulate matter from the air; and accumulating the droplets and particulate matter.

It is believed that the method and apparatus for removing particulate matter suspended in a fluid medium has been fully shown and described above and should be fully understood without further explanation. It is to be understood that considerable variations and modifications of the above noted method and apparatus may be made without departing from the spirit or scope of the invention as defined in the appended claims.

What it is desired to be secured by Letters Patent of the United States is:

1. A particle precipitator for removing particulate matter suspended in a gaseous medium including in combination, a housing having a chamber therein for passage of said gaseous medium therethrough, means for injecting a liquid into said chamber to successively form droplets therein, a.c. signal generation means operative to develop an a.c. signal having a frequency of at least the order of magnitude of the frequency of droplet formation of said liquid, said a.c. signal generation means being coupled to said injecting means for imposing a substantially fixed charge on each of said successively formed droplets in response to said a.c. signal forming successively charged droplets, the said successively charged droplets having different charge magnitudes and polarities and thereafter being operative to develop a nonuniform electric field within said chamber sufficient to capture said particles and remove same from said gaseous medium concurrently with the movement of the droplets through said chamber.

2. The apparatus of claim 1 wherein said housing is substantially cylindrical in shape and includes a gaseous medium exit port and an input port formed in said housing for allowing said gaseous medium to enter said chamber and circulate around the perimeter thereof.

3. The apparatus of claim 2 wherein the input port is formed such that the entering gaseous medium creates a cyclone effect upon entry.

4. The apparatus of claim 1 wherein said housing includes, nozzle means coupled to said injection means for receiving said liquid and for forming said droplets.

5. The apparatus of claim 4 wherein said nozzle means is positioned in the top of said housing and said nozzle means provide droplets which form a conical volume in said chamber.

6. The apparatus of claim 4 wherein a.c. signal generation means is coupled to said nozzle means.

7. The apparatus of claim 4 wherein said injection means includes resonator means coupling said liquid to said nozzle means and being further coupled to said a.c. signal generation means, said resonator means being operative to resonate at the frequency of said a.c. signal generation means and to impart said a.c. signal developed by said a.c. signal generation means to said liquid.

8. The apparatus of claim 7 wherein said resonator means includes a conductive coil conduit means for allowing passage therethrough of said liquid, said conduit forming an inductive reactance, and capacitive reactance means coupled to said conduit means.

9. The apparatus of claim 8 wherein said capacitive reactance means includes a housing surrounding said conduit means and secured thereto.

10. The apparatus of claim 7 wherein said resonator means is positioned within the said housing.

11. The apparatus of claim 1 further including collection means coupled to said chamber for collecting said droplets after passage through said chamber, filter means coupled to said collection means for filtering said collected droplets and removing said particulate matter and, recirculation means coupled to said filter means and said injecting means for returning said liquid to said injecting means.

12. The apparatus of claim 11 further including particle sensing means coupled to said collection means for analyzing said collected particulate matter.

13. A method for removing particulate matter suspended in a gaseous medium, including the steps of, a. spraying droplets of a liquid into a chamber, said droplets being formed from said liquid at a first droplet formation rate, b. applying an a.c. signal to said droplets having a frequency such that individual droplets are charged differently than their neighbors, for randomly charging said droplets as said droplets are sprayed into said chamber whereby said droplets create a nonuniform electric field within said chamber, c. exposing said gaseous medium with particulate matter suspended therein to said nonuniform electrical field and said droplets in said chamber for precipitating said particulate matter from said gaseous medium, d. accumulating said droplets and particulate 14. The method of claim 13 wherein said step of exposing said gaseous medium with particulate matter suspended therein includes the steps of entering said gaseous medium into said chamber, passing said gaseous medium through said precipitation chamber, and removing said gaseous medium.

15. The method of claim 14 wherein said step of passing said gaseous medium through said chamber includes the step of passing said gaseous medium through said chamber in a manner which creates a cyclone effect.

16. The method of claim 13 further including the steps of, filtering said accumulated droplets and particulate matter to remove said particulate matter, and forming said droplets from said filtered and accumulated droplets.

* * * * *

UNITED STATES PATENT AND TRADEMARK OFFICE

CERTIFICATE OF CORRECTION

PATENT NO. : 3,988,128

DATED : October 26, 1976

INVENTOR(S) : Walter R. Hogg

It is certified that error appears in the above-identified patent and that said Letters Patent are hereby corrected as shown below:

In column 2, line 4, "C." should begin a new paragraph.
In column 3, line 50, change "34" to read -- 24 --.
In column 4, line 66, change "here" to read -- there --.
In column 8, line 22, after "particulate" insert -- matter --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*